US006871708B2

(12) United States Patent
Calder et al.

(10) Patent No.: US 6,871,708 B2
(45) Date of Patent: Mar. 29, 2005

(54) CUTTINGS INJECTION AND ANNULUS REMEDIATION SYSTEMS FOR WELLHEADS

(75) Inventors: Ian Douglas Calder, Bieldside (GB); Amin Radi, Nassau Bay, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/818,221

(22) Filed: Apr. 5, 2004

(65) Prior Publication Data

US 2004/0188095 A1 Sep. 30, 2004

Related U.S. Application Data

(63) Continuation of application No. 10/077,231, filed on Feb. 15, 2002, now abandoned.
(60) Provisional application No. 60/271,016, filed on Feb. 23, 2001.

(51) Int. Cl.[7] ..... E21B 33/043; E21B 21/00
(52) U.S. Cl. ..... 166/348; 166/88.4; 166/89.1; 166/90.1; 166/368
(58) Field of Search ..... 166/368, 348, 166/88.4, 89.1, 358, 90.1, 242.3, 242.5, 89.2

(56) References Cited

U.S. PATENT DOCUMENTS 4,836,579 A * 6/1989 Wester et al. ..... 285/3
4,903,774 A * 2/1990 Dykes et al. ..... 166/363
5,188,181 A * 2/1993 Brammer et al. ..... 166/344
5,339,912 A * 8/1994 Hosie et al. ..... 175/66
5,662,169 A * 9/1997 Hosie ..... 166/344
5,865,250 A * 2/1999 Gariepy ..... 166/375
5,884,715 A * 3/1999 Reddoch ..... 175/66
5,927,405 A * 7/1999 Monjure et al. ..... 166/384
5,992,527 A * 11/1999 Garnham et al. ..... 166/379
6,227,300 B1 * 5/2001 Cunningham et al. ..... 166/339
6,394,194 B1 * 5/2002 Queen et al. ..... 175/66
6,470,971 B1 * 10/2002 Bridges ..... 166/379
6,494,267 B2 * 12/2002 Allen ..... 166/347
2002/0062965 A1 * 5/2002 Allen ..... 166/368
2002/0062966 A1 * 5/2002 Allen ..... 166/382

FOREIGN PATENT DOCUMENTS

GB 2350136 A * 11/2000

* cited by examiner

*Primary Examiner*—Hoang Dang
(74) *Attorney, Agent, or Firm*—Bracewell & Patterson, L.L.P.

(57) ABSTRACT

A wellhead assembly has an inner wellhead that lands in an outer wellhead, the inner wellhead having first and second internal passages. Each passage has an upper opening at the outer surface of the inner housing and a lower opening at the inner surface. An external shoulder of a casing hanger lands on an internal shoulder of the inner housing, the lower opening of the first passage being below the internal shoulder, the lower opening of the second passage being above the internal shoulder. The casing hanger has a substantially-vertical passage located in its sidewall, an upper port registering with the lower opening of the second passage, a lower port being located below the external shoulder for communicating with the annulus. Valve assemblies at the upper openings control the flow of heavy fluid injected into a casing annulus through the second passage and of cuttings injected into the annulus through the first passage.

17 Claims, 3 Drawing Sheets

CUTTINGS INJECTION AND ANNULUS REMEDIATION SYSTEMS FOR WELLHEADS

CROSS REFERENCE TO RELATED APPLICATIONS

This application is a continuation of application Ser. No. 10/077,231, filed Feb. 15, 2002 abandoned, entitled "Cuttings Injection and Annulus Remediation Systems for Wellhead", which application claimed the priority of provisional patent application Ser. No. 60/271,016, filed Feb. 23, 2001.

FIELD OF THE INVENTION

This invention generally relates to wellhead and casing assemblies for oil production and particularly relates to an assembly providing for cuttings injection and annulus remediation.

DESCRIPTION OF THE PRIOR ART

When a subsea well is drilled, cuttings, which are small chips and pieces of various earth formations, will be circulated upward in the drilling mud to the drilling vessel. These cuttings are separated from the drilling mud and the drilling mud is pumped back into the well, maintaining continuous circulation while drilling. The cuttings in the past have been dumped back into the sea.

While such practice is acceptable for use with water based drilling muds, oil based drilling muds have advantages in some earth formations. The cuttings would be contaminated with the oil, which would result in pollution if dumped back into the sea. As a result, environmental regulations now prohibit the dumping into the sea cuttings of produced with oil based drilling mud. There have been various proposals to dispose of the oil base cuttings. One proposal is to inject the cuttings back into a well. The well could be the well that is being drilled, or the well could be an adjacent subsea well. Various proposals in patents suggest pumping the cuttings down an annulus between two sets of casing into an annular space in the well that has a porous formation. The cuttings would be ground up into a slurry and injected into the porous earth formation. Subsequently, the well receiving the injected cuttings would be completed into a production well.

U.S. Pat. No. 5,085,277, Feb. 4, 1992, Hans P. Hopper, shows equipment for injecting cuttings into an annulus surrounding casing. The equipment utilizes piping through a template or guide base and through ports in specially constructed inner and outer wellhead housings. While feasible, the method taught in that patent requires extensive modification to conventional subsea structure.

Two patents provide for alternative devices for injecting cuttings. U.S. Pat. No. 5,339,912 to Hosie, et al., discloses a system having an injection adapter that removably mounts in an upper portion of a wellhead housing for injecting cuttings into the casing annulus. U.S. Pat. No. 5,662,169 to Hosie is for a wellhead system with a stab movable into engagement with the wellhead. The stab moves a flapper valve to communicate with the casing annulus for injection of a cuttings slurry.

Another problem encountered in wells is that of annular pressure control. In the annulus between different casing sizes, pressure may develop due to leaks between strings of casing. Previously, to control the pressure, a relatively heavy liquid is pumped into the annulus at the upper end of the well. The heavy liquid migrates slowly downward, displacing lighter liquid. This technique does not always work. U.S. Pat. No. 5,927,405 to Monjure, et al. discloses a system for lowering a flexible hose into the annulus for injecting a heavy fluid at a lower portion of the annulus.

There is a need for a wellhead assembly that provides for both cuttings injection and annulus remediation functions, eliminating the need for running separate tools or wellhead assemblies.

SUMMARY OF THE INVENTION

A wellhead assembly has an inner wellhead that lands in an outer wellhead, the inner wellhead having first and second internal passages. Each passage has an upper opening at the outer surface of the inner housing and a lower opening at the inner surface of the inner housing. An external shoulder of a casing hanger lands on an internal shoulder of the inner wellhead housing, the lower opening of the first passage being below the shoulder, the lower opening of the second passage being above the shoulder. The casing hanger has a substantially-vertical inner passage located in its sidewall, an upper port registering with the lower opening of the second passage, and a lower port located below the shoulder for communicating with an annulus formed between strings of casing. A conduit extends from the lower port into the annulus for conducting fluid from the inner passage to a lower portion of the annulus. Valve assemblies are located at the upper openings for controlling control fluid flow through the first and second passages.

To inject fluid for annulus remediation, A heavy fluid is injected into the annulus through the second passage, the fluid entering the inner passage of the casing hanger and traveling downward through the conduit. Lighter fluid is displaced and flows upward out of the annulus through the first passage. A slurry of cuttings can be injected into the annulus through the first passage to flow downward in the annulus and into a porous formation below the lower end of the outer string of casing.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
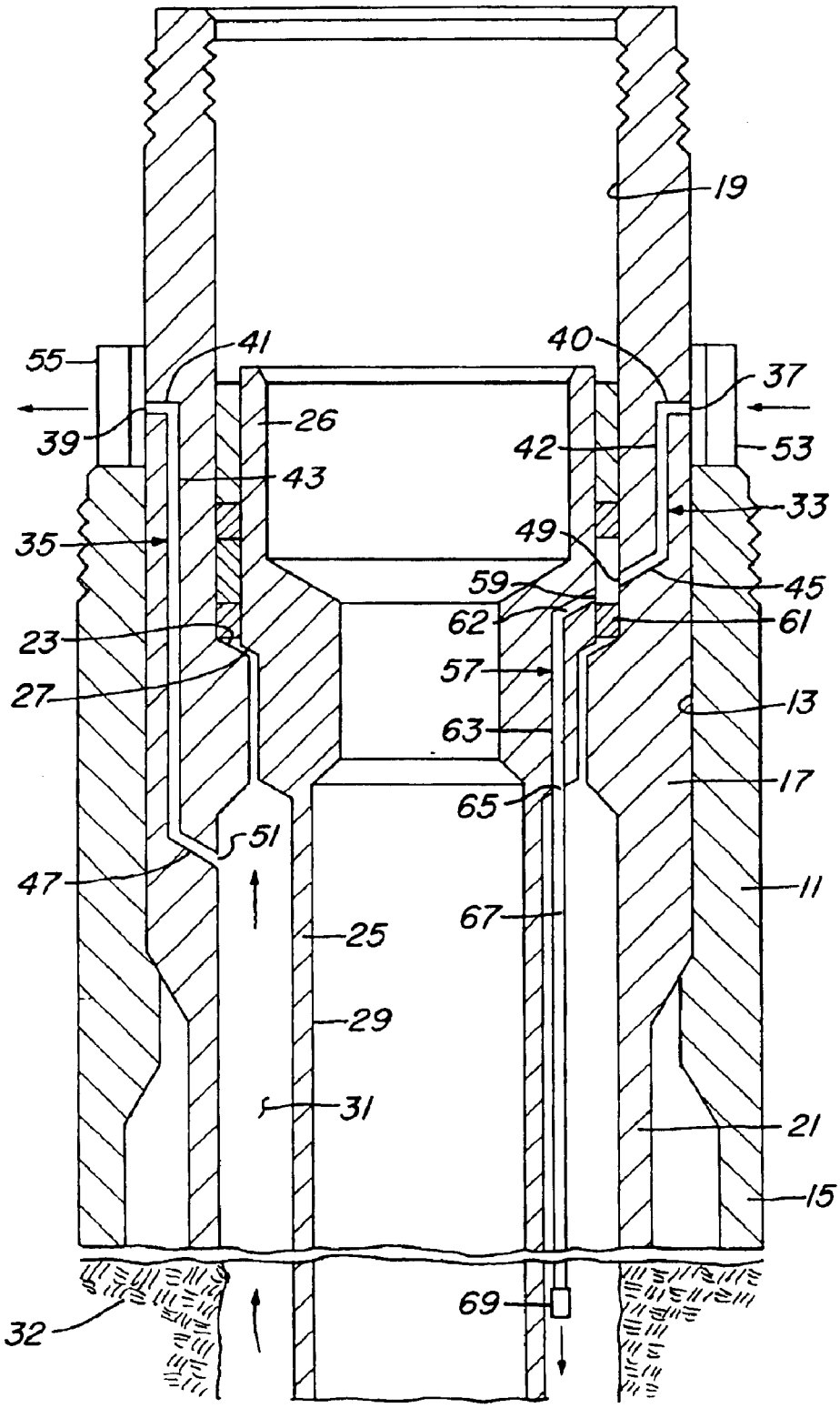
FIG. 1 is a cross-sectional view of a wellhead assembly having cuttings-injection and annulus-remediation systems and constructed in accordance with the present invention, the flow of fluid being shown as during annulus remediation.
Figure 2:
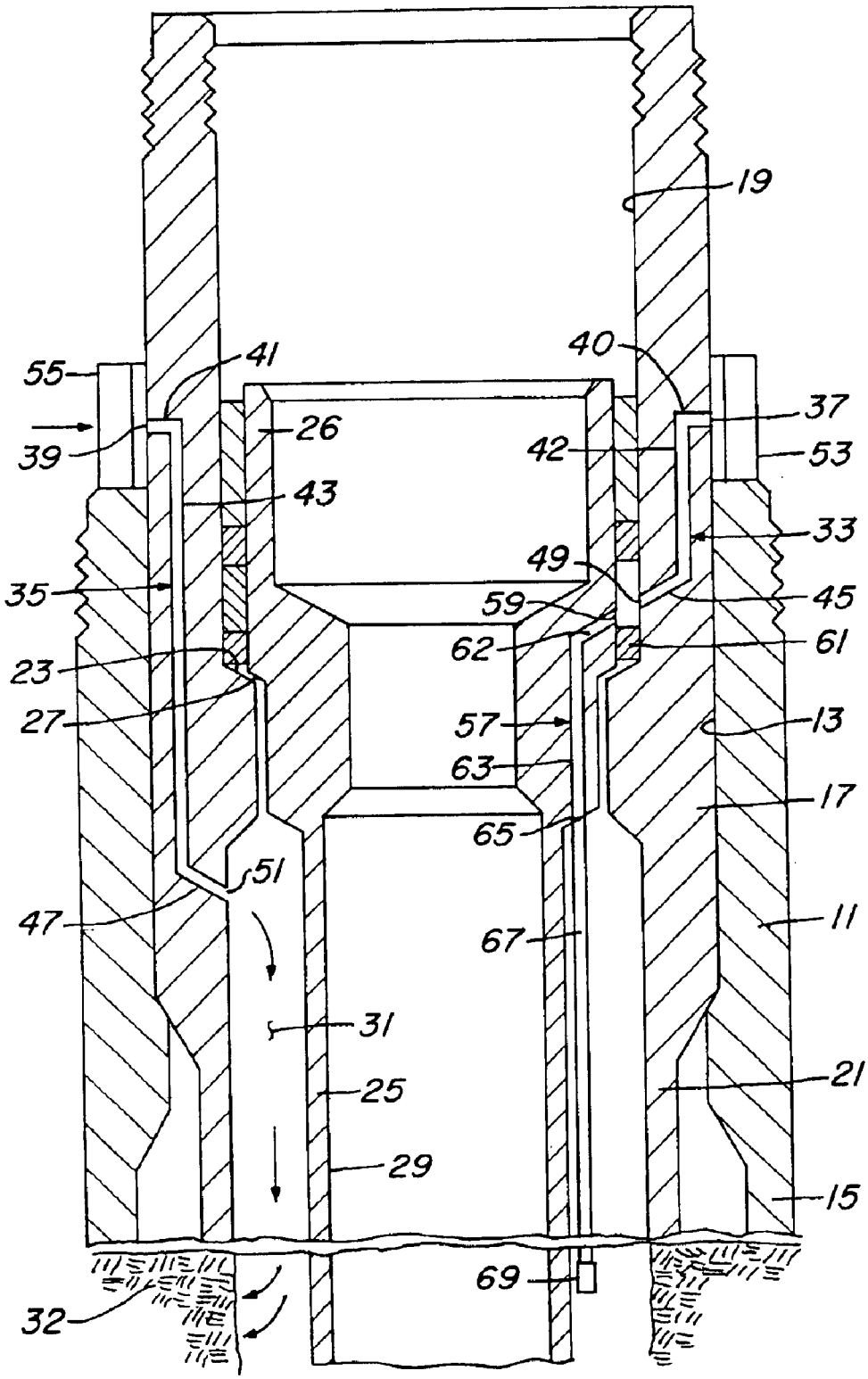
FIG. 2 is a cross-sectional view of the wellhead assembly of FIG. 1, the wellhead assembly being constructed in accordance with the present invention, the flow of fluid being shown as during cuttings injection.
Figure 3:
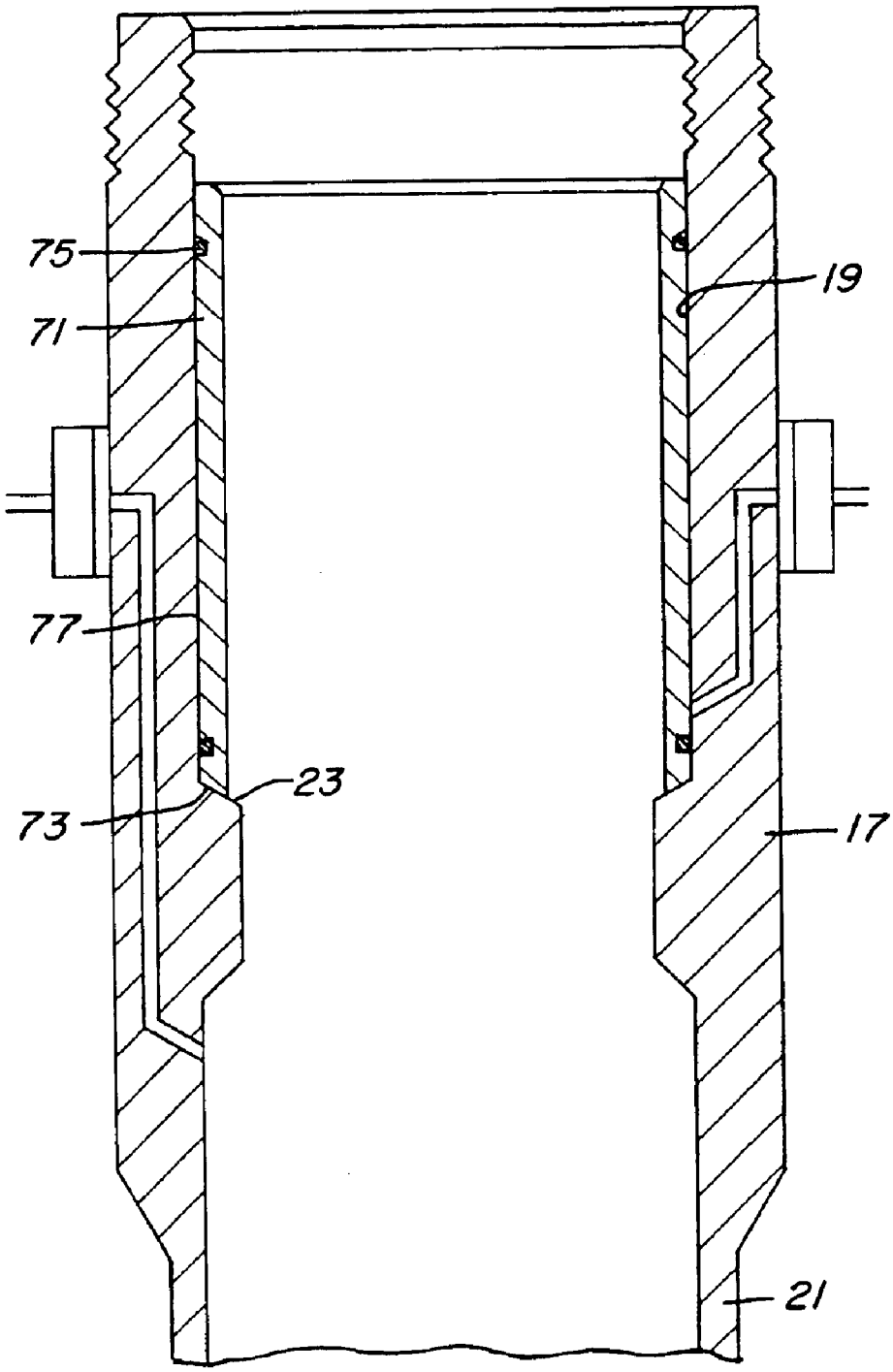
FIG. 3 is a cross-sectional view of a tubing hanger constructed in accordance with the present invention and having a seat protector installed therein.

FIGS. 1 through 3 show a wellhead and casing assembly having both cuttings-injection and annulus-remediation systems. The annulus-remediation system is used to inject heavy fluids when needed to prevent leakage of fluids into the annulus located between adjacent strings of casing. The cuttings-injection system is used to inject a slurry of cuttings from the drilling of a nearby well into the annulus. These cuttings are injected into the annulus to permanently and safely dispose of the cuttings.

Referring to FIGS. 1 and 2, an outer wellhead housing 11 is a large tubular member having a bore 13 located on a vertical axis. A conductor pipe 15 is secured to the lower end of outer wellhead housing 11. Inner wellhead housing 17 is a large tubular member that has a bore 19 on a vertical axis and fits securely into bore 13 of outer wellhead housing 11. The upper end of inner wellhead housing 17 protrudes above outer wellhead housing 11, and a string of outer casing 21 is secured to the lower end of inner wellhead housing 17. Inner wellhead housing 17 has an internal shoulder 23 located in bore 19 for supporting a string of inner casing 25, casing 25 being supported by a casing hanger 26 having a mating external shoulder 27, casing 25 having a vertical bore 29. The two strings of casing 21, 25 define an annulus 31. At a depth below where outer casing 21 terminates, the outer surface of annulus 31 is defined by the wellbore at a porous formation 32. For more detail on the assembly and installation of wellhead housings, see, for example, U.S. Pat. No. 5,662,169.

Inner wellhead housing 17 has a passage 33 through its sidewall for injecting remediation fluids and a passage 35 for injecting cuttings. Each passage 33, 35 has an upper opening 37, 39, respectively, on the external surface of inner wellhead housing 17 that is located above outer wellhead housing 11. Annulus-remediation passage 33 has an upper portion 40 beginning at upper opening 37 and leading to a vertical portion 42 running downward within the sidewall of inner wellhead housing 17. Vertical portion 42 leads to lower portion 45 which is angled toward bore 19. Passage 33 terminates in a lower opening 49 in bore 19 of inner wellhead housing 17 that is located above shoulder 23. Likewise, cuttings-injection passage 35 has an upper portion 41 that begins at upper opening 39 and extends to vertical portion 43. Vertical portion 43 extends downward in the sidewall to lower portion 47, which is angled towards bore 19 and terminates at lower opening 51. Lower opening 51 is also located in bore 19 of inner wellhead housing 17, but opening 51 is located below shoulder 23 and communicates passage 35 with annulus 31. Each upper opening 37, 39 has a valve assembly 53, 55, respectively, for controlling access to upper opening 37, 39.

Casing hanger 26 has an internal passage 57 with an upper opening 59 for communicating with lower opening 49 of remediation passage 33 in inner wellhead housing 17. Upper opening 59 is located above shoulder 27 and registers with lower opening 49 when casing hanger 26 is installed within inner wellhead housing 17. Seals 61 are positioned above and below openings 49, 59 to prevent leakage of remediation fluid from the interface of openings 49, 59 and to prevent contaminants from entering passages 33, 57. Upper portion 62 of passage 57 is angled toward bore 19, leading to a vertical lower portion 63 terminating in a lower opening 65. Lower opening 65 has a connector for attaching a conduit 67 deployed within annulus 31 and below passage 57. In the preferred embodiment, conduit 67 is a tube terminating in a check or pressure-relief valve 69. Alternatively, conduit 67 may terminate with a burst disk or other cap for retaining pressure within conduit 67. Conduit 67 may extend for thousands of feet downhole, though the lower end of conduit 67 will be above the level of cement in annulus 31.

Referring now to FIG. 3, a seat protector 71 is inserted into bore 19 of inner wellhead housing 17 after housing 17 is installed in outer wellhead housing 11 and before drilling is continued. Seat protector 71 is a tubular sleeve having an outer diameter which is slightly less than the inner diameter of bore 19 above shoulder 23. The lower end of protector 71 has a mating shoulder 73 for engaging shoulder 23 to support protector 71. Seals 75 are located on the external surface and sealingly engage bore 19 to prevent leakage into a narrow annulus 77 defined by seat protector 71 and bore 19. Seat protector 71 must be removed prior to installing casing hanger 26 and casing string 25.

In operation, outer wellhead housing 11 and conductor pipe 15 are installed, then inner wellhead housing 17, seat protector 71, and outer casing 21 are installed within bore 13 of outer wellhead housing 11. Drilling continues until the proper depth is reached, then seat protector 71 is removed from within bore 19. Inner casing 25 is lowered into bore 19 of inner wellhead housing 17, and conduit 67 may be installed and lowered into the well along casing 25. Once casing hanger 26 lands, shoulders 23, 27 mate, and passages 33, 57 align. Cement is pumped downward through bore 29 of casing 25 to flow up annulus 31. Casing hanger seals 61 are installed. A string of tubing (not shown) will be installed for producing well fluids.

Pressure in casing annulus 31 can be monitored through passage 35. If pressure begins to build up in casing annulus 31, a heavy fluid is circulated through annulus 31. FIG. 1 shows the direction of fluid flow during annulus remediation. Valve 53 is opened to allow the pressure of the heavy fluid in conduit 67 to increase to a level which overcomes resistance from check valve 69. Fluid passes through passage 33 and passage 57 and through conduit 67 to be injected downhole. Valve 55 is opened to allow fluid displaced by the injection of the heavy fluid to move up annulus 31, through passage 35, and out of valve 55.

FIG. 2 shows the direction of fluid flow during cuttings injection. The cuttings may be from this well, or may be from an adjacent well being drilled. The injection of cuttings occurs only after casing 25 is installed. Valve 55 is opened to allow the slurry of cuttings to flow through passage 35 and into annulus 31. Cuttings travel down annulus 31 until reaching the end of outer casing 21 and then flow into porous formation 32 surrounding casing 25. Cuttings injection would not occur simultaneously with casing annulus remediation.

Using the present invention has the advantage of providing systems for both annulus remediation and cuttings injection in the same assembly. As fluid is displaced by heavy fluids during remediation, the cuttings injection valve provides a controlled exit path for the displaced fluids.

While the invention has been shown in only one of its forms, it is not thus limited but is susceptible to various changes and modifications without departing from the spirit thereof.

We claim:

1. A subsea wellhead assembly, comprising:

an outer wellhead housing;

an inner wellhead housing;

at least one casing hanger landed in the inner wellhead housing and sealed by a packoff;

a passage extending downward through a sidewall of the inner wellhead housing from an upper opening on an exterior of the inner wellhead housing to a lower opening in an interior of the inner wellhead housing, the upper opening being above the outer wellhead housing, the lower opening being below the packoff; and a passageway extending downward through the sidewall of the inner wellhead housing from an upper opening on an exterior of the inner wellhead housing to a lower opening in the interior of the inner wellhead housing, the upper opening of the passageway being above the outer wellhead housing, the lower opening of the passageway being below the packoff, wherein a portion of the passageway passes through the casing hanger, the lower opening of the passageway being located on an exterior portion of the casing hanger.

2. The assembly of claim 1, wherein the packoff comprises upper and lower portions axially spaced apart from each other, the passageway extending between the upper and lower portions.

3. A subsea wellhead assembly, comprising:

an outer wellhead housing;

an inner wellhead housing;

at least one casing hanger landed in the inner wellhead housing and sealed by a packoff;

a first passage extending downward through a sidewall of the inner wellhead housing from an upper opening on an exterior of the inner wellhead housing to a lower opening in an interior of the inner wellhead housing, the upper opening being above the outer wellhead housing, the lower opening being below the packoff;

a second passage extending downward through the sidewall of the inner wellhead housing from an upper opening on an exterior of the inner wellhead housing to a lower opening in the interior of the inner wellhead housing, the upper opening of the second passage being above the outer wellhead housing, the lower opening of the second passage being above the packoff; and a retrievable seat protector located in a bore of the inner wellhead housing and covering the lower opening of the second passage prior to the casing hanger being landed.

4. In a subsea wellhead assembly having an outer wellhead housing connected to a string of conductor pipe, forming an outer wellhead assembly, an inner wellhead housing which lands in the outer wellhead housing and is connected to a first string of casing, forming an inner wellhead assembly, a casing hanger which lands on an internal landing shoulder in the inner wellhead housing and is connected to a second string of casing, the improvement comprising in combination:

first and second passages in the inner wellhead assembly, each passage having an upper opening at an outer surface of the inner wellhead housing and a lower opening at an inner surface of the inner wellhead housing, the lower opening of the first passage being located below the landing shoulder and in communication with an annulus surrounding the second string of casing, the lower opening of the second passage being located above the landing shoulder;

a casing hanger passage in the casing hanger, the casing hanger passage having an upper opening at an outer surface of the casing hanger and above the landing shoulder, the casing hanger passage also having a lower opening at an outer surface of the casing hanger and below the landing shoulder;

a conduit extending alongside the second string of casing from the lower opening of the casing hanger passage for delivering a fluid into a lower portion of the annulus; and wherein the lower opening of the second passage and the upper opening of the casing hanger passage are in communication with each other.

5. The wellhead assembly of claim 4, further comprising:

a seal located between the inner surface of the inner wellhead housing and the outer surface of the casing hanger, the seal defining a sealed passage between the lower opening of the second passage and the upper opening of the casing hanger passage.

6. The wellhead assembly of claim 4, comprising:

a valve assembly located at each upper opening of the first and second passages for controlling fluid flow through the passages.

7. The wellhead assembly of claim 4, further comprising:

a packoff located between the casing hanger passage and the inner wellhead housing above the landing shoulder, the packoff having upper and lower seal portions axially spaced apart from each other, defining a sealed passage that communicates the lower opening of the second passage with the casing hanger passage.

8. The wellhead assembly of claim 4, further comprising:

a retrievable seat protector located in a bore of the inner wellhead housing and covering the lower opening of the second passage prior to the casing hanger being landed.

9. A method of injecting a fluid and a volume of cuttings into an annulus of a well, the method comprising;

(a) providing a wellhead assembly having a string of casing defining a casing annulus, first and second passages leading from an exterior portion of the wellhead assembly to the annulus, and a conduit extending downward in the annulus to a selected depth, the conduit having an upper end in communication with the second passage;

(b) flowing the fluid downward through the second passage, through the conduit, and into the annulus, the fluid displacing existing fluids in the annulus, the existing fluids flowing upward and out of the annulus through the first passage; and (c) while step (b) is not occurring, flowing a fluid containing the cuttings downward through the first passage and into the annulus.

10. A method of injecting a fluid and offshore well drilling cuttings into an annulus of a well, the method comprising;

(a) installing an outer wellhead housing at a subsea floor, the outer wellhead housing being connected to a string of conductor pipe that extends into the well;

(b) landing an inner wellhead housing in the outer wellhead housing, the inner wellhead housing having first and second passages therethrough, each passage having an upper opening at an outer surface of the inner wellhead housing and a lower opening on an inner surface of the inner wellhead housing, the lower opening of the first passage being located below an internal shoulder, the lower opening of the second passage being located above the internal shoulder;

(c) securing a string of casing to a casing hanger and landing the casing hanger on the internal shoulder, the casing hanger having a passage sealingly communicating the lower opening of the second passage and a conduit extending alongside the casing in an annulus;

(d) pumping a fluid into the annulus through the second passage, with existing fluid located in the annulus being forced out of the annulus through the first passage; and (e) while step (d) is not occurring, pumping cuttings into the annulus through the first passage.

11. The method of claim 10, further comprising:

after step (b) and before step (c), inserting a seat protector within the bore of the inner wellhead housing to prevent contact with the lower opening of the second passage during drilling.

12. In a subsea wellhead assembly having a wellhead housing, a casing hanger that lands on an internal landing shoulder in the wellhead housing and is connected to a string of casing, the improvement comprising in combination:

a communication passage extending through a sidewall of the wellhead housing to an opening above the landing shoulder;

a casing hanger passage extending through the casing hanger offset from an axis of the casing hanger, the casing hanger passage being in communication with the communication passage;

a conduit extending alongside the string of casing in a casing annulus surrounding the casing, the conduit having an upper end connected to the casing hanger passage and a lower end at a selected depth; and a wellhead housing passage extending through a sidewall of the wellhead housing to the casing annulus to enable circulation of fluids down the conduit and back up the casing annulus to the wellhead housing passage.

13. The wellhead assembly according to claim 12, wherein the casing hanger is sealed to the wellhead housing by a casing hanger seal;

the casing hanger passage extends from below the casing hanger seal to a sealed annular space between the casing hanger and the wellhead housing above the casing hanger seal; and:

the communication passage extends from an exterior portion of the wellhead housing into fluid communication with the annular space.

14. A method of controlling casing annulus pressure with a wellhead assembly, comprising:

(a) positioning a conduit alongside a string of casing and lowering the conduit and the casing through a wellhead housing into the well;

(b) providing a casing hanger with a bore and a casing hanger passage offset from the bore, securing the casing hanger to an upper end of the string of casing and connecting an upper end of the conduit to a lower end of the casing hanger passage, landing the casing in the wellhead housing, and pumping cement into the casing and causing the cement to flow up for a selected distance a casing annulus surrounding the casing; then (c) in the event a pressure increase is detected at an upper end of the casing annulus, pumping a fluid through the casing hanger passage and conduit into the casing annulus.

15. The method according to claim 14, wherein the length of the conduit is selected so that the cement in the casing annulus will be below the lower end of the conduit.

16. The method according to claim 14, further comprising:

providing a return flow port in the wellhead housing that is in communication with the casing annulus; and step (c) further comprises circulating displaced fluid from the casing annulus out the return flow port.

17. The method according to claim 14, step (b) further comprises providing a communication passage through a sidewall of the wellhead housing and into communication with the casing hanger passage; and step (c) comprises pumping the fluid through the communication passage.

* * * * *